United States Patent [19]

Saito

[11] Patent Number: 4,534,676

[45] Date of Patent: Aug. 13, 1985

[54] EXCAVATING AND PROPELLING MACHINE FOR LAYING PIPELINES UNDERGROUND

[75] Inventor: Hiroshi Saito, Isehara, Japan

[73] Assignee: Kabushiki Kaisha Komatsu Seisakusho, Tokyo, Japan

[21] Appl. No.: 564,525

[22] Filed: Dec. 22, 1983

[30] Foreign Application Priority Data

Dec. 23, 1982 [JP] Japan ..... 57-194011

[51] Int. Cl.[3] ..... F16L 1/00

[52] U.S. Cl. ..... 405/184; 405/141; 175/53; 299/31; 299/45

[58] Field of Search ..... 405/184, 141, 132, 146; 299/3, 29, 31, 57, 45, 55, 56, 79, 81, 89, 90; 175/53, 62, 73

[56] References Cited

U.S. PATENT DOCUMENTS

| | | | |
|---|---|---|---|
| 825,857 | 7/1906 | Moran et al. | 299/56 |
| 1,511,957 | 10/1924 | Freda | 299/56 |
| 3,382,002 | 5/1968 | Tabor | 299/31 X |
| 3,413,033 | 11/1968 | Clark | 299/90 X |
| 3,767,836 | 10/1973 | Geis et al. . | |
| 3,830,545 | 8/1974 | Sugden | 299/33 |
| 3,902,563 | 9/1975 | Dunn . | |
| 3,938,597 | 2/1976 | Richmond et al. . | |
| 3,941,423 | 3/1976 | Garte | 299/57 |
| 4,024,721 | 5/1977 | Takada et al. | 405/184 |
| 4,332,420 | 1/1982 | Coski | 299/81 X |

FOREIGN PATENT DOCUMENTS 1572253 7/1980 United Kingdom .

*Primary Examiner*—Dennis L. Taylor

*Attorney, Agent, or Firm*—Armstrong, Nikaido, Marmelstein & Kubovcik

[57] ABSTRACT

An excavating and propelling machine for laying pipelines underground has a plum-pudding stone crusher device comprising a plurality of rod-shaped rotary teeth formed integrally on the rear face of a disk-shaped rotating cutter head in a manner of extending radially at uniform intervals spaced apart from one another and a plurality of rod-shaped stator teeth formed integrally on the front surface of an annular front face plate in a manner of extending radially at uniform intervals space apart from one another. The rotary teeth and the stator teeth are disposed in the vicinity of each other.

2 Claims, 3 Drawing Figures

EXCAVATING AND PROPELLING MACHINE FOR LAYING PIPELINES UNDERGROUND

BACKGROUND OF THE INVENTION

1. Field of the invention

This invention relates to an excavating and propelling machine for laying pipelines underground, and more particularly to an excavating and propelling machine for laying pipelines underground provided with a device for comparatively large crushing plum-pudding stones mixed in the excavated earth and sand so as to enable the whole excavated earth and sand to be transported successively and discharged.

2. Description of the prior art

Conventional excavating and propelling machines for laying pipelines underground are arranged to excavate the earth and sand in front of them by a pilot excavator device connected to the leading end of lengths of pipes to be laid underground and to advance the whole excavating and propelling machine by means of a pipe propelling machine located in a lanching pit behind it. During the period, the excavated earth and sand is changed in a slurry state by the water supplied by a water supply pump through a water supply pipeline installed in the buried pipeline into the pilot excavating machine, and then discharged by a sand pump etc. through a slurry pipeline installed also in the buried pipeline. The size of plum-pudding stones mixed in the slurry which can be discharged at that time is limited to a range of one-third to one half of the diameter of the muddy water discharge pipe which is a slurry passage and that of the discharge pipe connected to the sand pump.

Thus, the size of an excavated earth and sand intake port formed in the cutter head of the pilot excavator device must be determined taking into consideration the diameter of the discharge pipe. Therefore, the excavating and propelling machines of this kind are disadvantageous in that they cannot be used for grounds containing plum-pudding stones which are larger than the size of the earth and sand intake port.

SUMMARY OF THE INVENTION

The present invention has been devised to eliminate the above-mentioned disadvantage, and has for its first object to provide an excavating and propelling machine for laying pipelines underground provided with a device for crushing immediately even comparatively large sized plum-pudding stones irrespective of the diameter of the excavated earth and sand discharge pipe.

To achieve the above-mentioned first object, according to the present invention, there is provided an excavating and propelling machine for laying pipelines underground comprising a disk-shaped rotating cutter head having a plurality of excavating bits and a plurality of excavated earth and sand intake ports and adapted to be mounted on the leading end of a pilot excavator device body arranged to propel underground ahead of a pipeline to be laid underground; a plurality of rod-shaped rotary teeth formed integrally on the rear face of said cutter head in a manner of extending radially at uniform intervals spaced apart from one another; an annular front face plate having a plurality of excavated earth and sand passage holes communicating with the inside of said pilot excavator device body and disposed adjacent and opposite to said cutter head; and a plurality of rod-shaped stator teeth formed integrally on the front surface of the front face plate in a manner of extending radially at uniform intervals spaced apart from one another, said rotary teeth and said stator teeth forming in combination a plum-pudding stone crusher device.

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

The present invention will now be described in more detail with reference to the accompanying drawings showing embodiments of the present invention.

Figure 1:
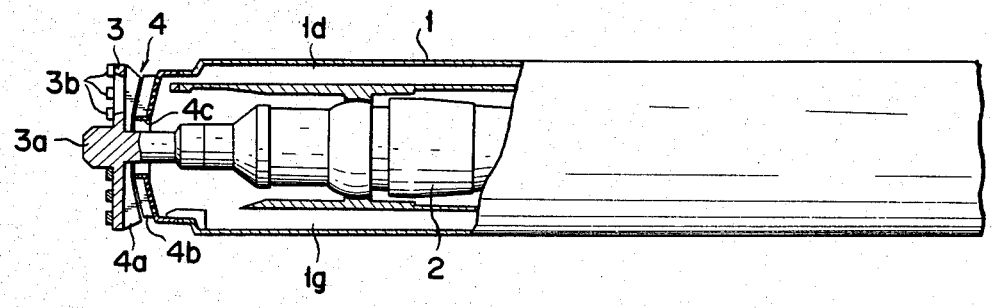
FIG. 1 is a fragmentary longitudinal schematic sectional view showing one embodiment of the excavating and propelling machine for laying pipelines underground according to the present invention.

In FIG. 1 showing schematically one embodiment of the excavating and propelling machine for laying pipelines underground, reference numeral 1 denotes a pilot excavator device body of the excavating and propelling machine adapted to be propelled, while excavating the ground, ahead of a pipeline (now shown) to be laid underground. Mounted on the leading end of the body 1 is a cutter head 3 which projects from the body 1 and is adapted to be rotated by a rotating prime mover 2. Further, the excavator device body 1 has formed therein a water supply passage 1*d* adapted to change the excavated earth and sand into a slurry state, and an excavated earth and sand discharge passage 1*g* for transporting rearwardly the excavated earth and sand in slurry state and discharging it by means of a sand pump or the like to a proper place on the ground.

Figure 2:
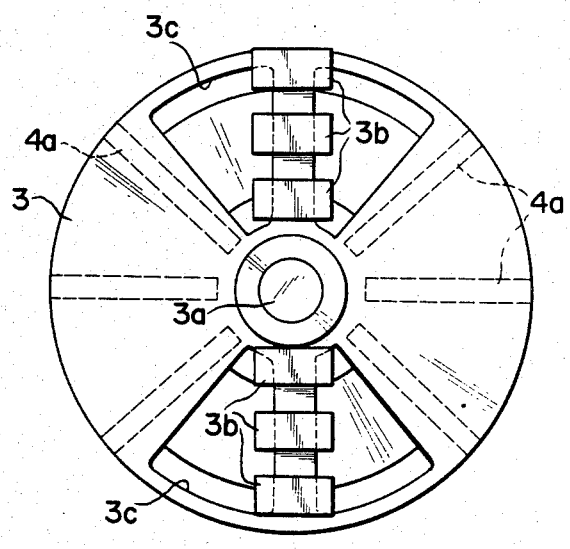
FIG. 2 is a front view of a cutter head adapted to be mounted on the leading end of the excavating and propelling machine for laying pipelines underground according to the present invention.
Figure 3:
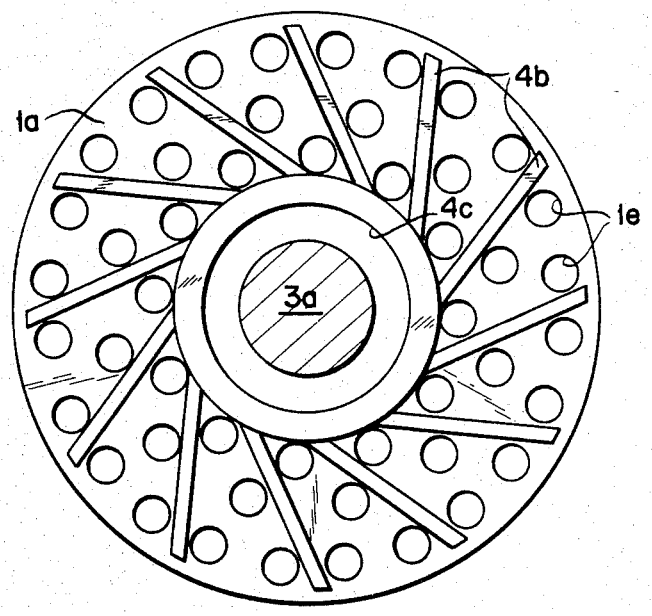
FIG. 3 is a partially sectional front view of a front face plate of the pilot excavator device body.

As shown in FIGS. 2 and 3, the cutter head 3 has a plurality of fan or segment-shaped excavated earth and sand intake ports 3*c* formed therein. Further, the cutter head 3 has a plurality of strip-shaped excavating bits 3*b* fixedly secured to the front surface thereof in parallel relationship between the intake ports 3*c*. Further, the cutter 3 has a plurality of radially extending rod-shaped rotary teeth 4*a* formed as an integral unit thereof on its rear surface at uniform intervals spaced apart from one another. The cutter head 3 can be attached and detached readily for the sake of convenience of replacement when it is worn away.

A front face plate 1*a* of the excavator device body 1 is disposed adjacent and opposite to the cutter head and consists of an annular plate having a relatively large hole 4*c* formed in the central part thereof to pass a cutter head rotating shaft 3*a* therethrough, and a large number of small diameter, earth and sand passage holes 1*e* perforated from the front surface to the rear surface for passing excavated earth and sand in slurry state into the excavator device body 1. This annular front face plate 1*a* has a plurality of rod-shaped stator teeth 4*b* formed as an integral unit thereof on its front surface at uniform intervals in the outer circumference thereof and which extend or diverge radially and tangentially of the inner circumference thereof. Thus, the rotary teeth 4*a* and the stator teeth 4*b* form a plum-pudding stone crusher device 4 in combination.

The operation of the excavating and propelling machine for laying pipelines underground constructed as mentioned above according to the present invention will now be described below.

The whole amount of the earth and sand excavated by the cutter head 3 rotated by a prime mover is taken through the excavated earth and sand intake ports 3*c* into the plum-pudding stone crusher device 4. Granular earth and sand pass directly through the earth and sand passage holes 1*e* perforated in the front face plate 1*a* into the pilot excavator device body 1, and are changed into slurry state with the water introduced by way of the water supply passage 1*d* so as to be discharged through the earth and sand discharge passage 1*g*. Whilst, large plum-pudding stones which cannot pass through the earth and sand passage holes 1*e* are carried into the spaces defined by the adjacent rotary teeth 4*a* and stator teeth 4*b* and having gradually reduced intervals towards the inner circumference so that they may be crushed by the same griding effect as obtained in the case of ordinary disk type crushers. The crushed plum-pudding stones will pass through the earth and sand passage holes 1*e* and the rotating shaft insertion hole 4*c* into the excavating device body 1.

It is to be understood that the foregoing description is merely illustrative of the preferred embodiments of the invention, and that the invention is not to be limited thereto, but is to be determined by the scope of the appended claims.

What is claimed is:

1. An excavating and propelling machine for laying pipelines underground, comprising a disk-shaped rotating cutter head having a plurality of excavating bits and a plurality of excavated earth and sand intake ports and adapted to be mounted on the leading end of a pilot excavator device body arranged to propel underground ahead of a pipeline to be laid underground; a plurality of rod-shaped rotary teeth formed integrally on the rear face of said cutter head in a manner of extending radially at uniform intervals spaced apart from one another; an annular front face plate having a plurality of excavated earth and sand passage holes communicating with the inside of said pilot excavator device body and located adjacent and opposite to said cutter head; and a plurality of rod-shaped stator teeth formed integrally on the front surface of the front face plate in a manner of extending radially at uniform intervals spaced apart from one another, said rotary teeth and said stator teeth forming in combination a plum-pudding stone crusher device.

2. The excavating and propelling machine for laying pipelines underground as claimed in claim 1, said rod-shaped stator teeth are diverged radially and tangentially from the inner circumference of the annular front face plate at uniform intervals.

* * * * *